United States Patent [19]

Colasante

[11] Patent Number: 4,538,596

[45] Date of Patent: Sep. 3, 1985

[54] PROPHYLAXIS OF ADHESIONS WITH LOW FREQUENCY SOUND

[76] Inventor: David A. Colasante, 2050 Westgate Dr., F—3, Bethlehem, Pa. 18018

[21] Appl. No.: 410,922

[22] Filed: Aug. 24, 1982

[51] Int. Cl.[3] ..... A61H 1/00

[52] U.S. Cl. ..... 128/32; 128/1 R

[58] Field of Search ..... 128/303 R, 328, 1 R, 128/32, 2

[56] References Cited

U.S. PATENT DOCUMENTS

| | | | |
|---|---|---|---|
| 1,566,731 | 12/1925 | Carrol . | |
| 3,085,568 | 4/1963 | Whitesell | 128/33 |
| 3,148,391 | 9/1964 | Whitney | 5/348 |
| 3,353,303 | 11/1967 | Delaney | 128/24 |
| 3,389,699 | 6/1968 | Mathers | 128/33 |
| 3,477,422 | 11/1969 | Jurist et al. | 128/2 |
| 3,499,436 | 3/1970 | Balamuth | 128/24 |
| 3,499,437 | 3/1970 | Balamuth | 128/24 |
| 3,664,332 | 5/1972 | Vecchio | 128/24.2 |
| 3,828,769 | 8/1974 | Mettler | 128/24 |
| 4,064,376 | 12/1977 | Yamada | 179/146 |
| 4,175,552 | 11/1979 | Johnson | 128/32 |
| 4,216,766 | 8/1980 | Duykers et al. | 128/32 X |

FOREIGN PATENT DOCUMENTS

| | | | |
|---|---|---|---|
| 984251 | 2/1976 | Canada | 128/19 |
| 608893 | 4/1926 | France . | |

OTHER PUBLICATIONS

Raf, L. E., "Cause of Abdominal Adhesions in Cases of Intestinal Obstructions", Acta Chir Scand. 135:73, 1969.

J. E. Guiffre, "Intestinal Obstruction: Ten Years Experience", *Dis. Colon. Rectum* 15:426, 1972.

Triotskii, R. A. "Role of Adhesions in Metastasis of Cancer in Peritoneal Cavity Organs", *Vestn. Akad. Med. Nauk. SSSR* 22:55, 1967.

Trotskii, R. A. "The Spread of Cancer in the Large Intestine in Adhesions Under Experimental Conditions", *Eksp. Khir. Anesteziol,* 15:44, 1970.

Ellis, H., "The Cause and Prevention of Postoperative Intraperitoneal Adhesions", *Surg., Gynecol, Obstet,* 133:497, 1971.

Nissel & Larrson "The Role of Blood and Fibrinogen in Development of Intra-Peritoneal Adhesion in Rats", *Fertil. Steril.* 30:470 1978.

Noble, T. B. "Plication of the Small Intestine as Prophylaxis Against Adhesions", *American Journal of Surgery,* 35:41, 1937.

Wilson, N. D. "Complications of Noble Procedure", American Journal of Surgery, 108:264, 1964.

Raloff, Janet "Noise Can Be Hazardous to Our Health", *Science News* 121:377-381, Jun. 5, 1982.

Mohr, G. C. et al., "Effects of Low Frequency and Infrasonic Noise on Man", *Aerospace Medicine* 36:817, 1965.

Slarve, R. N. and Johnson, D. L. "Human Whole-Body Exposure to Infrasound", *Aviation Space & Environmental Medicine* 46(4):428-331 1975.

Harris et al., "Review of Effects of Infrasound on Man", *Aviation, Space & Environmental Medicine* 47(4):430-34 (1976).

Evans et al., "Clinical Applications of Low Frequency Sound", *Sound* 5:47-51 (1971).

Colasante et al., "Prophylaxis of Adhesions with Low Frequency Sound", *Surgery, Gynecology & Obstetrics,* 153:357-359 (Sep. 1981).

"Design Your Own Base Reflex High-Fi Speaker System-Parts I and II", *Popular Electronics* 71:34, 72:70, (1974).

Swolin, "K. Experimentelle Studien Zur Prophylaxe Von Intra-Abdominal Verwachsungen" *Acta. Obstet., Gynec. Scand.* 45: 473 (1966).

*Primary Examiner*—Edward M. Coven

*Attorney, Agent, or Firm*—Woodcock, Washburn, Kurtz, Mackiewicz & Norris

[57] ABSTRACT

A therapeutic method for reducing the incidence of adhesions which are likely to form in regions of inflamed body tisssues is disclosed. This method comprises the step of exposing inflamed tissues, such as tissues in the region of recent surgery, to infrasound to reduce the incidence of adhesion formation.

27 Claims, No Drawings

PROPHYLAXIS OF ADHESIONS WITH LOW FREQUENCY SOUND

BACKGROUND

A. Field of the Invention

The present invention relates to the field of tissue adhesion treatment and prevention, and more particularly to a method for reducing the incidence of adhesions through the application of low frequency sound to inflamed body tissues and organs.

B. Adhesion Prevention and Treatment Techniques

Adhesions are a type of scar tissue which may undesirably form between inflamed or traumatized portions of an organ and adjacent body tissues. Almost any inflamed tissue can form adhesions to adjacent tissue if these tissues are left in contact over time. It is theorized that within several minutes light adhesions form, and are most frequently replaced after several days by heavy permanent adhesions.

It has been estimated that more than 98% of all patients undergoing abdominal surgery develop unwanted internal adhesions. Such adhesions also complicate pelvic, thoracic, articular and neuro surgery. Adhesions are the greatest cause of intestinal obstruction and strangulation. They are also the greatest cause of infertility in females. Once adhesions have formed, medical complications from those adhesions may develop at any point in a patient's lifetime.

Although the severity of adhesions has been reduced somewhat by enlighted surgical techniques, the incidence of adhesions following surgery is still quite high. In an article entitled "Cause of Abdominal Adhesions in Cases of Intestinal Obstructions", by L. E. Raf, *Acta Chir. Scand.*, 1969, 135:73, Raf reported that, of 2,295 records of patients with small bowel obstructions, 64% were secondary to intra-abdominal adhesions. As causative factors, previous appendectomy and gynecologic procedures were noted in 86%, while in 18% there was a history of infections. Intestinal obstrutions are lethal in 27% of patients in the sixth decade and 54% of those patients who are more than 70 years old. See "Intestinal Obstruction: Ten Years Experience", J. C. Giuffre, *Dis. Colon Rectum*, 1972, 15:426.

Adhesion etiologic factors involve inflammation which may be secondary to foreign bodies, infections, trauma, radiation, or, most potently, ischemic tissue of any sort. Deperitonealized surfaces are not a significant cause of adhesions; in fact, there is evidence suggesting that the suture material used in reperitonealization can cause adhesions. Adhesions of fibrin from blood clotting factors may be present two hours or less after an operation. Organization to fibrous adhesions comprising collagen occurs most frequently within two weeks. The latter plays a valuable role in supplying new vasculature, limiting infection and providing support for parenchymal discontinuities. The post-operative incidence of adhesions is increased in infants, but there is no preference for age or sex in adults.

It is not known whether the vast majority of adhesions are indeed harmless, as is sometimes suggested. Adhesions are often associated with abdominal pain and dyspareunia. The results of two studies by Triotskii implicate adhesions as the earliest route for metastatic spread of carcinoma within the abdomen. See Triotskii, R. A., "Role of Adhesions in Metastasis of Cancer in Peritoneal Cavity Organs", *Vestn. Akad. Med. Nauk., SSSR*, 1967, 22:55; and Trotskii, R. A.,; "The Spread of Cancer in the Large Instestine in Adhesions under Experimental Conditions", *Eksp. Khir anesteziol*, 1970, 15:44.

To date, many techniques have been suggested as a prophylaxis or treatment for adhesion formation. Such methods have generally involved either surgical intervention, drug administration, or mechanical manipulation or separation of the inflamed surfaces. To date, such procedures have attained only limited success due to the side effects attendant to such procedures and the inconsistent results achieved thereby.

To date, the preferred prophylaxis entails sterile technique antibiotics when appropriate, minimizing tissue damage and operating time, and protection from foreign substances. In "The Cause and Prevention of Postoperative Intraperitoneal Adhesions", by H. Ellis, *Surg. Gynecol. Obstet.*, 1971, 133:497; attempts at aggressive prophylaxis are summarized. Prevention of fibrin deposition by anticoagulants has been abandoned because of hemmorrhage. Removal of fibrin polymers by lavage and enzyme administration has proved to be inconsistent or ineffective. Furthermore, Nissel and Larrson have reported that fibrin is neither necessary nor sufficient for adhesion formation. See Nissel and Larrson, "The Role of Blood and Fibrinogen in Development of Intra-Peritoneal Adhesion in Rats", *Fertil. Steril.*, 1978, 30:470. Separation of serosal surfaces with oxygen, saline solution, oils or macromolecular solutions have been associated with increased adhesion formations. Similar results have occurred when traumatized surfaces have been covered with gold foil, amniotic membranes or omental grafts. Induced peristalsis with enemas, cathartics, heat or autonomic drugs has been dangerously difficult to control and associated with numerous ill side-effects. Corticotropin, steriods and other anti-inflammatory agents have shown prolonged healing time, ulcer generation and abscess formation without consistent prophylaxis of adhesions. Plication of the small intestine as recommended by Noble is an extensive procedure; it is reserved for those patients with multiple reformations. Results are again inconsistent. See T. B. Noble, "Plication of the Small Intestine as Prophylaxis Against Adhesions", *Am. J. Surg.*, 1937, 35:41. See also N. D. Wilson, "Complications of the Noble Procedure", *Am. J. Surg.*, 1964, 108:264. The removal of adhesions surgically almost certainly leads to a greater reformation of adhesions in the treated tissue region.

For organ surfaces to become adherent during an inflammatory epsiode, they must be in contact long enough for the polymerization of the fibrin and collagen fibers between them. In the case of abdominal surgery, the normal peristaltic motion of the bowels ceases for a time roughly proportional to the severity of the operation. Generally, in patients whose peristalsis returns rapidly, the number of adhesions is less.

Early researchers attempted to replace lost peristaltic motion by several methods. One method was to constantly change the position of the patients in bed. Another was to use large suction cups on the abdomen to alternatively pull and push the abdominal wall. Another method used forced feedings and enemas containing iron filings followed by the periodic movement of a strong magnet over the patient's abdomen. These methods were incompatible with the comfort and well being of the postoperative patients.

Thus, as seen from the above, considerable attention has been given to the problem of adhesion formation, and its prevention, however, a simple, safe technique which is effective to prevent adhesions has heretofore been unknown to the art.

C. Low Frequency Sound, Infrasound and Their Effects on Man

The effect of sound, particularly noise, on human health has been considered in recent years. In "noise Can Be Hazardous to our Health", by Janet Raloff, *Science News*, 121:377–381, June 5, 1982, it is generally suggested that noise, particularly high amplitude noise is generally hazardous to human health.

Some attention has also been directed at the effects of low frequency and infrasonic noise on man. The effect of infrasound on man was studied during the aerospace program in the 1960's in connection with anticipated exposures of man to high amplitude noise in the 1–100 cps range. Exposures up to 154 dB in the 1–100 cps range for short durations were then concluded to be well within human tolerance limits. See "Effects of Low Frequency and Infrasonic Noise on Man", by G. C. Mohr et al., *Aerospace Medicine,* 36:817. More recently, Slarve and Johnson investigated the effect of exposing human subjects to whole-body exposures to infrasound ranging from 1–20 Hz for a period of 8 minutes up to levels of 144 dB re 20 micropascal. Slarve and Johnson concluded that infrasound exposures as high as 140 dB are safe for healthy subjects, at least for periods of 8 minutes, and predicted that longer exposures would also be safe. See "Human Whole-Body Exposure to Infrasound" by R. N. Slarve and D. L. Johnson, *Aviation, Space, and Environmental Medicine*, 46 (4): 428–31 (1975). Slarve and Johnson did report that a sensation of pressure build-up in the ear often occurred at higher amplitudes, apparently due to inward deformation of the tympanic membrane caused by the pressure differential. This differential was postulated as resulting from a rectification effect by the eustachian tube. Voice modulation and small amounts of vibrations of the parts of the body were also consistently observed, however it was concluded that infrasound exposures as high as 144 dB were not harmful to healthy subjects.

In an article entitled "Review of the Effects of Infrasound on Man", by Harris et al, *Aviation, Space and Environmental Medicine,* 47 (4): 430–34 (1976), it was concluded that the levels at which infrasound become a hazard to man are still unknown, however, are certain to be much higher than have been suggested in some of the literature. In this excellent review, Harris et al consider the various reported side effects of exposure to infrasound, and pay particular attention to the suggestion of Evans et al that low frequency sound may have a clinical application is assessing vestibular function due to its potential for eliciting nystagmus. See also, Evans, et al, "Clinical Applications of Low Freqeuncy Sounds", *Sound*, 5:47–51 (1971).

Thus, as seen from the above description, the effects of low frequency sound or infrasound on humans have been primarily, although not exclusively, investigated to determine their potential adverse effects on health.

D. Other Sound and Vibrational Therapeutic Methods

Over the years, various clinical methods have been suggested which utilize, in one form or another, sound or vibrational energy.

The use of vibrational energy in the field of physiotherapy, or to cause muscle relaxation, to slow breathing and heart rate, and otherwise relax a patient is well known. Various apparatus and methods using sound or vibrational energy to directly effect a patient or operator of a given device are disclosed in the following U.S. and foreign patents: Nos. 1,566,731 (Carrol) (Device for aiding the hearing) 3,085,568 (Whitesell) Physiotherapy apparatus 3,148,391 (Whitney) Support device; 3,389,699 (Mathers) (Roller massage assembly); 3,664,332 (Vecchio) (Therapeutic, vibrating pad); 4,064,376 (Yamada) (Sound reproduction system and device); 4,175,552 (Johnson) (Vibration device; and Canadian 984,251 (Laskovitz) (Massage apparatus). Other devices and methods have been disclosed wherein vibratory, sonic or infrasonic energy is disclosed as being useful in a therapeutic or diagnostic context. See for example the following U.S. and foreign patents: U.S. Pat. No. 3,828,769 (Mettler) (Method and apparatus for ultrasonic treatment of lower tissues simultaneous with heating of subcutaneous outer muscle and lower tissues); 3,499,436 (Balamuth) (Method and apparatus for treatment of organic structures with a coherent elastic energy wave); 3,477,422 (Jurist, Jr. et al) (Vibratory bone density determination method and apparatus); 3,352,303 (Delaney) (Method for blood clot lysis; 3,499,437 (Balamuth) (Method and apparatus for treatment of organic structures and systems thereof with ultrasonic energy) and French Pat. No. 608,893 (Moner-1926) (Infrasound apparatus for use in therapeutic applications).

E. Summary

As seen from the above, the prior art methods fail to provide a simple effective method for substantially reducing the incidence of adhesions. Although various sonic, subsonic, and supersonic methods and apparatuses have been suggested, none have been suggested as being therapeutic for the prophylaxis of adhesions.

SUMMARY OF THE INVENTION

The present invention provides a novel therapeutic method for preventing or reducing the incidence of serious adhesions in patients who have recently suffered tissue trauma such as the tissue trauma resulting from recent surgery or wound closure. Applicant has recognized that for organ surfaces to become adherent during an inflammatory episode, they must be in stationary contact long enough for the theorized polymerization of fibrin and/or collagen fibers between them to take place. Applicant has further recognized that such polymerization can be prevented or reduced by inducing a relative micromotion of the target organ surfaces by exposing them to resonant low frequency sound. This controlled micromotion inhibits adhesion formation and is without serious side effects.

The incidence of adhesions which are otherwise likely to form in regions of inflamed body tissues may thus be substantially reduced by exposing said tissues to low frequency sound in accordance with the herein disclosed techniques. Because sound waves are transmitted through air, no direct physical contact between the patient and the low frequency sound source is required. The method of the present invention is therefore uniquely suited to prevent intra-abdomonal adhesions, which are a leading cause of intestinal obstructions and infertility in females.

Accordingly, a primary object of the present invention is the provision of improved adhesion prophylaxis methods.

A further object of the present invention is the provision of improved methods of surgery and wound closurewhich exhibit a reduced incidence of adhesion formation.

A further object of the present invention is a method for preventing sterility in females by reducing the incidence of adhesions which are otherwise likely to form in regions of inflamed abdominal tissues.

These and other objects of the present invention will become apparent from the following, more detailed description.

DESCRIPTION OF THE PREFERRED EMBODIMENTS

In the following description various examples have been selected for the purposes of illustration. Portions of my invention and of these examples have previously been described in out prior publication entitled "Prophylaxis of Adhesions with Low Frequency Sound", by Drs. Colasante, Au, Sell and Tyson which appeared in *Surgery, Gynecology and Obstetrics,* 153:357–359, September 1981, which is hereby incorporated by reference. Those of ordinary skill in the art will recognize that they can make various changes in the materials and methods described herein without departing from the scope of the present invention, which is defined more particularly in the appended claims.

The present invention relates to a method for reducing the incidence of adhesions. This method involves the treatment of at least a portion of a body organ suspected of being susceptible to the development of adhesions and comprises the step of vibrating, or causing the micromotion of, that organ relative to its surrounding body tissues. This vibration is preferably induced using low frequency sound waves which are applied to the target tissues at a frequency of about the estimated resonant frequency of the target organ. As used herein, the term "low frequency sound" means sound waves having a frequency below the audible range of the human ear, or between about 1 and 50 cycles per second. For example, applicant has estimated the resonant frequency of the small intestine to be about 15 cycles per second. However, because bowel resonance may vary from subject to subject and due to differences in weight, bowel contents or autonomic nervous tone, frequency sweeps in the range of 5 to 35 cycles administered in pulses of preselected duration are presently preferred.

It is, an object of the present method to prevent adhesion formation without interferring with otherwise beneficial aspects of the healing process. Low frequency sound has been selected since sufficient organ displacement is achievable at amplitudes of between 100–180 dB, preferably 120–160 dB, or about 140 dB. These amplitudes are sufficient to reduce or prevent the theorized deposition architecture of fibrin and collagen fibers might otherwise span between adjacent tissue surfaces, yet are not so great as to interfere with intra-organ healing. Additional advantages are obtained from the use of low frequency sound since no direct physical contact between the patient and the low frequency sound source is required.

Vibration of the target organ at its resonant frequency sould begin immediately following surgery or other trauma, such as wound closure, and continue at least during the period when the affected body tissues are inflamed. It is presently preferred to provide periodic pulses of vibratory energy at least as frequently as once each minute, preferably every 30 seconds, and to provide a pulse length of at least 1 second, preferably about 30 seconds, during the entire period of treatment. It is also preferred to continue treatment for at least 8 days, and preferably about 14 days or more following surgery or other trauma. In those instances where more than one target organ is to be treated, or where the resonant frequency of a given target organ is difficult to estimate, vibratory energy of varying frequencies in the range of from about 5 to 35 cycles per second may be applied to effect treatment. In the preferred embodiment, low frequency sound is generated by an audio type speaker which is driven by a sine wave signal which varies in frequency during each duty cycle.

The preferred source of vibratory energy is sound energy. It is anticipated that other forms of compressional wave energy may eventually be utilized to induce the organ micromotion which has been shown to be effective in reducing the incidence of adhesions. It is accordingly anticipated that mechanically induced compressional wave energy which is fluid coupled to the body, particularly to the abdomen or back, may be used for performing the desired treatment. In all instances, however shear-wave type energy and coupling of vibrational energy to skeleton should be avoided to ensure patient comfort during the required, relatively prolonged treatment period.

As seen from the above, the present invention also provides an improved method for treating internal body tissues which comprises the steps of performing surgery to at least gain access to said internal body tissues, and applying resonant vibratory energy, preferably low frequency sound, to said body tissues during the period of healing to reduce the incidence of adhesions which might otherwise form in the region of said tissues. This method may further comprise the step of introducing a prosthesis such as a surgical suture of surgical staple into the region of said internal body tissues to alter the resonance characteristics of that region. If desired, the frequency of the vibratory energy applied to the affected region may be selected in accordance with the resonant frequency resulting from the introduction of the prosthesis introduced into that region.

The present invention may be further understood by reference to the following examples:

EXAMPLE I

A voltage sine wave generator was designed and built to turn on for 30 seconds and off for 30 seconds repeatedly. During the on time, the frequency was swept from 5 cylces per second to 35 cycles per second. This frequency range was arbitrarily chosen to be within a range of inaudible sound and to cover the probable resonant frequencies of the target organs and organ portions to be treated. The aforementioned swept sine wave signal was fed through an amplifier to drive speaker to produce a sound intensity of 120 decibels.

Ten laboratory rats were obtained and anesthetized with ether. An abdominal incision was then made, the cecum was lifted out and a measured portion was crushed with a hemostat for 60 seconds before returning it to the abdomen. The incision was closed with 000 silk sutures. Two weeks were allowed to pass after placing 4 rates in front of the speaker and 4 rats in another room. (Two rats died during anesthesia). Two rats in each group died from infection during the two week period. Of the two remaining rats in the control group, both developed severe adhesions, as discovered on autopsy. Of the two remaining rats in front of the speaker, one had moderate adhesions and one had no adhesions.

EXAMPLE 2

A group of 100 Sprague-Dawley rats, weighing between 200 and 240 grams, were subjected to a second experiment.In this experiment, an amplifier was used to produce a 50 watt signal from the aforementioned sine wave signal to drive a transducer. The transducer consisted of a two cubic meter enclosure containing a 38 cm speaker constructed according to Weems, as described in "Design Your Own Base Reflex High-Fi Speaker System—Parts I, II, "*Popular Electronics* 71:34, 72:70 (1974). Wire-mesh cells were arranged in a 3×8 cell array to match the sides of the transducer enclosure. Each cell was 10×13×43 cm with a cardboard lining. Food pellets, paper strips and a water bottle were applied to each. The array was positioned to face the transducer at a distance of 70 cm.

Using clean technique, a laparotomy was carried out through a midline incision and the cecum exposed. Cecal crush was carried out to create adhesions. A 0.3 square cm area was crushed for one minute with a hemostat as described by Swolin in "K. Experimentelle Studien Zur Prophylaxe von Intra-Abdominal Verwachsungen", *Acta Obstet. Gynec. Scand.* 45:473 (1966). Concurrently, a four digit color code of random assignment was applied to the tail with the permanent laundry markers. The surgeon was unaware of the assignment of the rat. The cecum was then replaced and the wound closed in one layer with 4 interrupted 000 silk sutures. Control rats, group 1, were kept in the laboratory. The experimental rats, groups 2, 3 and 4, were removed within 20 minutes to the running apparatus in another part of the building. These control groups, which were operated upon and exposed sequentially, were exposed for 6 hours, 40 hours and 12 days respectively. The transducer in the above-described apparatus was replaced after each group due to burn out. All rats were then sacrificed in a closed carbon dioxide chamber. The bodies were arranged randomly and the abdominal contents exposed. The surgeon, unaware of the group assignements, examined the intestine for the presence of adhesions which were subjectively graded as severe, moderate or slight.

This experiment demonstrated that there was a decreased incidence of adhesions in those groups exposed to low frequency sound, and among the rats exposed, the incidence is inversely proportional to the duration of exposure. The adhesion rate for rats in group 1, which were the control rats, was 83%, while adhesions rates for experimental rats in groups 2, 3 and 4, were 69%, 41%, and 23% respectively. Analysis by chi-square test indicates very significant results for those in groups 3 and 4. Further analysis with the normal Z Table verifies the statistical significance with respect to the number of rats in each group. Twelve rats died during the the operation, and 33 died of infection postoperatively without preference to the group. The number of rats in group 4 was intentionally larger than the other groups to enhance the statistical significance of this group.

Of the 18 control rats in group 1, 15 or 83% had adhesions develop and these were graded as severe in 4, moderate in 9 and mild adhesions in 2. Group 2 consisted of 19 rats exposed to infrasound pulses for 6 hours. There was an adhesion rate of 68% distributed as severe in 4, moderate in 6 and mild in 3. The 18 rats in group 3 had a rate of 41% adhesion formation after 40 hours exposure. These were divided into severe in 1 rat, moderate in 6 rats, and slight adhesions in one rat. Group 4 contained 30 rats exposed to infrasound pulses for 12 days with an adhesion rate of 23%- severe in 1 rat, moderate in 3 rats and mild adhesions in 4.

EXAMPLE 3

A further experiment was undertaken using dogs who were exposed to low frequency sound at approximately 100 dB. The dogs were anesthetized using Nembutol as the anesthetic. Adhesions were caused in all dogs by scraping the intestine with a tooth brush. Another operation was performed removing these adhesions as an inducement to further adhesions. At this point, 12 dogs were exposed to infrasound and 13 were controls. 1 control dog died. After 8 days, the speakers failed, and after 14 days all dogs were sacrificed and autopsied. Of the control dogs, 7 had massive adhesions, 4 had moderate adhesions and 1 had slight adhesions. Of the exposed dogs 4 had massive adhesions, 2 had moderate adhesions 4 had slight adhesions and 2 had no adhesions. In spite of the seemly favorable results of this study during a relatively short exposure, due to uncertainty concerning the intensity of low frequency sound actually maintained during the 8 day exposure period before confirmed speaker failure, the data obtained from this example is not considered to be as good as the data reported in Example 2 above, and may not be statistically significant.

In each of the above-described examples, it should be noted that food consumption, water consumption, feces count and aggressiveness of the animals did not vary significantly from control to exposure groups. During the subject experiments, the applicant was exposed to prolonged periods of infrasound (hours at a time) and in each case did not note any adverse feelings, including particular attention to nausea, fatigue, vertigo, appetite or emotional irritability.

Because the acoustic resonance of abdominal organs occur conveniently below the audible frequency range, even relatively high intensities of low frequency sound are not annoying. It must be noted that the more subtle acoustic energy transmitted through air used in this study is distinguished from vibrational energy involving conduction through major proportions of the skeleton. However, fluid coupling of compressional wave energy to the body tissue, and not the skeleton, may be possible, thereby eliminating problems which have been encountered concerning the durability of speakers used in the studies.

In view of man's evolution among many natural low frequency sound sources, it is not unexpected that these and other studies have failed to demonstrate significant side effects of low frequency sound even above 150 dB. In modern life, man is frequently exposed to low frequency sound vibrations emitted from lawn mowers, automobiles and aircraft.

It is currently anticipated that by using cadavers, specific organ resonance may be measured. In accordance with this invention, organ vibrations of the target organ surfaces relative to surrounding body tissues should create relative micromotion displacements of at least about 10 microns, but less than about 2 millimeters. The use of specific resonant frequencies, instead of sweeping frequencies, may thus minimize the pulse duration needed. It is additionally contemplated that the maximum effective pause between pulses may be determined, and that critical post-operative exposure periods may be identified which will permit strategic use of the methods rather than the continuous pulsing which was used during the above-described experiments. It is presently believed that pulsing is important during recumbency but may be unnecessary during ambulation because ambulation can generate motion of intra-abdominal organs. Effective prophylaxis of foreign body and infection induced adhesions should also be obtainable using the method of the present invention. Ovarian tubual adhesions resulting from inflammatory disease are also particularly important as modulators of fertility, and should be treatable using the method of the present invention.

Keeping in mind the multiple consideration of post-operative patients, other possible effects of low frequency sound may include an antistatis effect within deep venous pools reducing the danger of emboli. Cutaneous resonances might change the incidence of decubitus ulcers by a massaging effect. Pulmonary frequencies may aid in breaking up mucus accumulations or stimulate cillary activity. Finally, a cautious approach to cardiac resonances must be adopted despite the presence of such frequencies in the daily environment of the patient.

As seen from the above, a double blind experimental study has shown that high intensity low frequency sound is effective as a prophylaxis for post operative adhesion formation. The controlled application of low frequency sound generates micromotion of the abdominal organs, thereby preventing moving surfaces from lending themselves to spanning fiber formation. As a result, an effective, relatively simple, low cost technique is provided which should be effective as an adhesion prophylaxis.

What is claimed:

1. A therapeutic method for reducing the incidence of adhesions which are likely to form in regions of inflamed body tissue, comprising the step of exposing said tissues to low frequency sound to reduce the incidence of said adhesions, said exposure being periodic and occurring at least during a period of time when said body tissues are inflamed.

2. The therapeutic method of claim 1 wherein said tissues are exposed to said low frequency sound following trauma sustained in the region of said tissues.

3. The method of claim 2 wherein said trauma is surgery.

4. The therapeutic method of claim 1 wherein said tissues are intra-abdominal tissues.

5. The therapeutic method of claim 4 wherein said tissues are the tissues of intra-abdominal organs.

6. The therapeutic method of claim 5 wherein said intra-abdominal organs are intestinal organs.

7. The therapeutic method of claim 1 wherein said periodic exposure continues at least until said body tissues are no longer inflamed.

8. The therapeutic method of claim 7 wherein said periodic exposure occurs at least once per minute.

9. The therapeutic method of claim 8 wherein each periodic exposure continues for a period of at least 1 second.

10. The therapeutic method of claim 1 wherein said exposure begins following surgery and continues for a period of at least 6 hours.

11. The therapeutic method of claim 10 wherein said exposure continues for at least 48 hours following surgery.

12. The therapeutic method of claim 1 wherein said low frequency sound has a frequency between 1 and 50 cycles per second.

13. The therapeutic method of claim 12 wherein said low frequency sound has a frequency of between 5 and 35 cycles per second.

14. The therapeutic method of claim 1 wherein said inflamed body tissues comprise organs, and wherein said low frequency sound comprises a resonant frequency of at least one of said organs to be treated.

15. The therapeutic method of claim 1 wherein the patient is exposed to low frequency sound having an amplitude of between 100 and 180 dB.

16. The therapeutic method of claim 15 wherein said amplitude of low frequency sound is between 120–160 dB.

17. The method of claim 16 wherein said amplitude is about 140 dB.

18. A therapeutic method for reducing the incidence of adhesions which are likely to form in regions of inflamed body tissues, comprising the step of exposing said tissues to low frequency sound to reduce the incidence of adhesions, said low frequency sound having a frequency of between 5 and 35 cycles per second and being varied during such exposure through a range of from 5 to 35 cycles per second.

19. The therapeutic method of claim 18 wherein said low frequency sound is generated by an audio type speaker.

20. The therapeutic method of claim 19 wherein said audio speaker is driven by a sine wave signal.

21. The therapeutic method of claim 20 wherein said sine wave signal varies in frequency during its duty cycle.

22. The therapeutic method of claim 21 wherein said sine wave signal is interrupted with a pause of preselected duration between said duty cycles.

23. A method of treating internal body tissues comprising the steps of:

(a) performing surgery to at least gain access to said internal body tissues; and (b) applying low frequency sound to said body tissues during at least a portion of the period of healing to reduce the incidence of adhesions which might otherwise form in the region of said tissues.

24. The method of claim 23 further comprising the step of introducing a prosthesis into the region of said internal tissues.

25. The method of claim 24 wherein said prosthesis is a surgical suture.

26. The method of claim 23 wherein said suture is a surgical staple.

27. A therapeutic method for reducing the incidence of adhesions which are likely to form in regions of inflamed body tissues, comprising the step of exposing said tissues to low frequency sound to reduce said adhesions, said low frequency sound being generated by an audio type speaker which is driven by a sine wave signal which is varied in frequency during its duty cycle.

* * * * *